US005834701A

United States Patent [19]

Saka et al.

[11] Patent Number: 5,834,701

[45] Date of Patent: Nov. 10, 1998

[54] FLAT MULTIPLE-CORE CABLE

[75] Inventors: Kazuhito Saka; Tetsuya Iwasaki, both of Yokkaichi, Japan

[73] Assignee: Sumitomo Wiring Systems, Ltd., Japan

[21] Appl. No.: 574,126

[22] Filed: Dec. 18, 1995

[30] Foreign Application Priority Data

Jan. 20, 1995 [JP] Japan ..... 7-007309

[51] Int. Cl.[6] ..... H01B 11/00

[52] U.S. Cl. ..... 174/117 F; 174/117 A

[58] Field of Search ..... 174/117 F, 117 R, 174/117 FF, 117 A, 117 M, 36

[56] References Cited

U.S. PATENT DOCUMENTS

| | | | |
|---|---|---|---|
| 4,113,335 | 9/1978 | Lang et al. | 174/117 F |
| 4,381,208 | 4/1983 | Baverstock | 156/52 X |
| 4,701,576 | 10/1987 | Wada et al. | 174/117 F |
| 4,815,981 | 3/1989 | Mizno | 439/77 X |
| 4,992,625 | 2/1991 | Izui et al. | 174/36 |
| 5,147,510 | 9/1992 | Iura et al. | 174/117 F |
| 5,206,462 | 4/1993 | Iura et al. | 174/117 F |
| 5,499,928 | 3/1996 | Satoh | 439/492 X |

FOREIGN PATENT DOCUMENTS 2 156 603 of 1985 United Kingdom .

*Primary Examiner*—Kristine L. Kincaid
*Assistant Examiner*—Chau N. Nguyen
*Attorney, Agent, or Firm*—Anthony J. Casella; Gerald E. Hespos; Ludomir A. Budzyn

[57] ABSTRACT

Flat cables 12 are arranged on a plane, and insulating sheaths 11 are fused and connected at ends of the flat cables 12 to form a first fused portion 16. A second fused portion 17 is formed next to the first fused portion 16. Further, the insulating sheaths 11 are fused and connected in intermediate positions of the respective flat cables 12, thereby forming a third fused portion 19. The first fused portion 16 strengthens the connection of a flat multiple-core cable at its opposite ends without fusing and adhering a tape thereto. The second fused portion 17 prevents the flat multiple-core cable from being bent during the insertion into a terminal in an equipment. After the insertion, the second fused portion 17 having a sufficient flexibility permits the flat multiple-core cable to be bent near the opening of the terminal. Further, the third fused portion 19 enables the connection of the respective flat cables in their intermediate positions without the use of a connecting member, thereby reducing a production cost and making the flat multiple-core cable suitable for use in a wiring in a narrow space.

6 Claims, 12 Drawing Sheets

FLAT MULTIPLE-CORE CABLE

BACKGROUND OF THE INVENTION

1. Field of the Invention

The present invention relates to a flat multiple-core cable for use e.g. in a wiring of public utility equipment, office automation equipment or an electronic device to be mounted in an automotive vehicle.

2. Description of the Prior Art

A known flat multiple-core cable of this type is, for example, as shown in FIG. 8. This multiple-core cable includes a plurality of flat cables 53 arranged in parallel on a plane. Insulating sheaths 52 of the flat cables 53 are peeled off at their ends, thereby forming a contact portion 54. A conductor connecting tape 55*a* is adhered to the contact portion 54 and the insulating sheaths 52 near the contact portion 54 on one surface of the respective cables arranged in parallel. In order to strengthen the connection of the flat cables 53 at their ends, a sheath connecting tape 58 is fused and adhered to the insulating sheaths 52 near the contact portion 54 on the other surface of the respective cables.

However, the sheath connecting tape 58 leads to an increased production cost of the known flat multiple-core cable shown in FIG. 8.

Further, in the known flat multiple-core cable shown in FIG. 8, the respective flat cables are likely to come apart behind the conductor connecting tape 55*a* because they are not connected there. Accordingly, as shown in FIG. 12, when the contact portion 54 is inserted into a terminal 63 of equipment or the like, an inserting force is locally exerted on the respective flat cables 53 behind the conductor connecting tape 55*a*, thereby causing them to bend. Such bending of the flat cables 53 may cause a defective electrical connection.

In another flat multiple-core cable as shown in FIG. 9, a conductor connecting tape 55*b* wider than that of the flat multiple-core cable as shown in FIG. 8 is adhered. If the contact portion 54 is inserted into the terminal 63 of the equipment while gripping the conductor connecting tape 55*b*, the respective flat cables 53 will not come apart and, therefore, are not bent at the opening of the terminal 63.

However, with the known flat multiple-core cable as shown in FIG. 9, after the contact portion 54 is inserted into the terminal 63 of the equipment, the flat multiple-core cable is bent in a position away from the opening of the terminal 63 since the conductor connecting tape 55*b* is wide, thereby pressing other parts in the equipment.

Further, the conductor connecting tape 55*b* leads to an increased production cost because it is wider than the prior art conductor connecting tape.

On the other hand, in order to prevent the respective flat cables from coming apart in intermediate positions of the flat multiple-core cable as described above, fusible tapes 60 are fused in intermediate positions to connect the flat cables 53 as shown in FIG. 10. Alternatively, the flat cables 53 may be tied with bandings 61 as shown in FIG. 11.

However, in the known flat multiple-core cable as shown in FIG. 10, the fusible tapes 60 lead to an increased production cost. Further, since the fusible tapes 60 bulge from the flat multiple-core cable, they may catch other parts of the equipment, thereby becoming a hindrance during wiring.

Further, in the known flat multiple-core cable as shown in FIG. 11, the bandings 61 tying the flat cables 53 in the intermediate positions lead to an increased production cost.

Further, since known the flat multiple-core cable loses one of its advantages, namely, its thinness in the positions where the flat wires 53 are tied with the bandings 61, it may not be suitable for use in a narrow space. Furthermore, the tying with the bandings 61 shortens the flat multiple-core cable.

In order to solve the above problems, an object of the invention is to provide an improved flat multiple-core cable which can be fabricated at a reduced cost, in particular is insertable without being bent, and is suitable for a wiring in a narrow space.

SUMMARY OF THE INVENTION

According to the invention, there is provided a flat multiple-core cable, comprising: a plurality of cables arranged in parallel, each cable comprising a conductor and an insulating sheath covering the conductor, a contact portion formed of the conductors exposed by peeling off the insulating sheaths of the respective cables at at least one of their ends, and a fused portion formed by fusing and connecting the neighbouring insulating sheaths in an area adjacent to the contact portion.

According to a preferred embodiment, the flat multiple-core cable further comprises a conductor connecting tape adhered to the contact portion and the insulating sheaths adjoining the contact portion on the respective cables.

Preferably, the fused portion comprises a first fused portion formed by fusing and connecting the neighbouring insulating sheaths in an area at least partly overlapping with an area of the conductor connecting tape.

According to a further preferred embodiment, the fused portion comprises a second fused portion formed by fusing and connecting the neighbouring insulating sheaths in an area adjacent to an area of the conductor connecting tape.

Preferably, the conductor connecting tape is provided on one surface of the respective cables and wherein a sheath connecting tape is adhered to the insulating sheaths on the other surface of the respective cables.

Further preferably, the sheath connecting tape is provided adjacent to the contact portion.

According to a further preferred embodiment, the flat multiple core cable further comprises at least one intermediate fused portion formed by fusing and connecting the neighbouring insulating sheaths in an intermediate area of the respective cables.

Furthermore, the fusing is preferably provided by melting and/or heating and/or gluing and/or ultrasonic welding and/or by means of a solvent.

Preferably, the fused portion is formed by fusing and connecting the neighbouring insulating sheaths in an area adjoining to the contact portion.

Preferably, the flat multiple-core cable comprises a plurality of cables arranged in parallel on a plane, each cable consisting essentially of a conductor and an insulating sheath covering the conductor; a contact portion formed of conductors exposed by peeling off the insulating sheaths of the respective cables at their ends; a conductor connecting tape adhered to the contact portion and the insulating sheaths near the contact portion on one surface of the respective cables arranged in parallel; and a first fused portion formed by fusing and connecting the adjacent insulating sheaths in an area corresponding to the conductor connecting tape.

Since the flat multiple-core cable comprises the first fused portion formed by fusing and connecting the adjacent insulating sheaths near the ends of the respective cables, the connection of the respective cables at their ends can be strengthened without using a sheath connecting tape.

As described above, the connection of the respective cables at their ends can be reinforced without using a sheath connecting tape, leading to a reduced production cost.

Further preferably, the flat multiple-core cable comprises a plurality of cables arranged in parallel on a plane, each cable consisting essentially of a conductor and an insulating sheath covering the conductor; a contact portion formed of conductors exposed by peeling off the insulating sheaths of the respective cables at their ends; a conductor connecting tape adhered to the contact portion and the insulating sheaths near the contact portion on one surface of the respective cables arranged in parallel, and a second fused portion formed by fusing and connecting the adjacent insulating sheaths in an area adjacent to the conductor connecting tape.

The above flat multiple-core cable comprises the second fused portion formed by fusing and connecting the adjacent insulating sheaths in the area adjacent to the conductor connecting tape. Accordingly, if this flat multiple-core cable is inserted into a terminal of an equipment or the like while gripping the second fused portion, the respective cables will not come apart in the gripped position. Thus, the flat multiple-core cable can be inserted without being bent. After the insertion, since the second fused portion has a sufficient flexibility, the flat multiple-core cable is bent near the second fused portion.

Accordingly, the flat multiple-core cable can be inserted into a terminal of an equipment or the like without being bent if the second fused portion is gripped during the insertion.

After the insertion, this cable is bent near the second fused portion because the second fused portion has a sufficient flexibility. Accordingly, this cable does not press other parts in the equipment, and is suitable for use in a narrow space.

Further preferably, a sheath connecting tape may be provided which is adhered to the insulating sheaths near the contact portion on the other surface of the respective cables arranged in parallel.

The connection of the respective cables can be reinforced if the sheath connecting tape is adhered to the insulating sheaths near the contact portion on the other surface of the respective cables arranged in parallel.

Further, the flat multiple-core cable comprises a plurality of cables arranged in parallel on a plane, each cable consisting essentially of a conductor and an insulating sheath covering the conductor, a contact portion formed of conductors exposed by peeling off the insulating sheaths of the respective cables at their ends, a conductor connecting tape adhered to the contact portion and the insulating sheaths near the contact portion on one surface of the respective cables arranged in parallel; and a third or intermediate fused portion formed by fusing and connecting the adjacent insulating sheaths in an intermediate area of the respective cables.

Further, the above flat multiple-core cable comprises the third fused portion formed by fusing and connecting the adjacent insulating sheaths in the intermediate area of the respective cables. Accordingly, without using a fusible tape or a banding, the respective cables can be connected in their intermediate areas while the flat multiple-core cable flat keeps its flat shape.

If the flat multiple-core cable is connected by the third fused portion(s) in its intermediate position(s) without using a connecting member such as a fusible tape and a banding, a production cost can be reduced. Further, since this cable is flat, it is suitable for use in a narrow space. Furthermore, the fabricated flat multiple-core cable is not shortened as in the prior art where the respective flat cables are tied in their intermediate position(s).

These and other objects, features and advantages of the present invention will become more apparent upon a reading of the following detailed description and accompanying drawings.

DETAILED DESCRIPTION OF THE PREFERRED EMBODIMENT

Hereafter, embodiments of the invention are described with respect to the accompanying drawings.

Figure 1A:
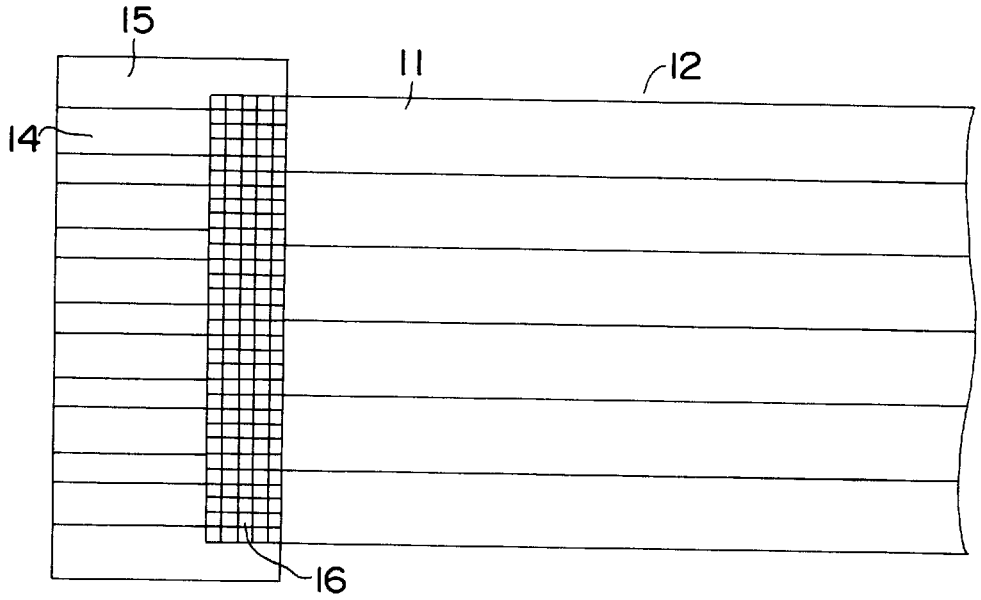
FIGS. 1(*a*) and 1(*b*) are plan and side views of a flat multiple-core cable as a first embodiment of the invention respectively.
Figure 1B:
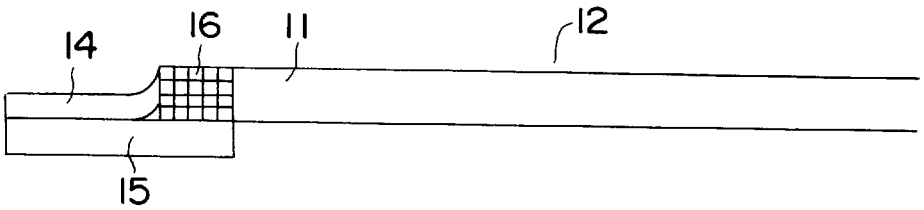

The flat multiple-core cable of the first embodiment is such as shown in FIG. 1. Specifically, each flat cable 12 is formed by covering a flat rectangular conductor of a copper foil or a copper foil plated with tin with an insulating sheath 11 of thermoplastic resin such as polyvinyl chloride (PVC) or polyethylene (PE) by means of extrusion. A plurality of such flat cables 12 are arranged in parallel on a plane. The sheaths 11 are peeled off at opposite ends of the respective flat cables 12, and the exposed flat rectangular conductors form a contact portion 14. A conductor connecting tape 15 of insulating resin is preferably adhered to the contact portion 14 and the insulating sheaths 11 near the contact portion 14 on one surface (lower surface) of the arranged flat cables 12. The insulating sheaths 11 are heated and fused in an area corresponding to the conductor connecting tape 15, thereby forming a first fused portion 16 (hatched portion in FIG. 1), so that adjacent insulating sheaths are connected.

Figure 2:
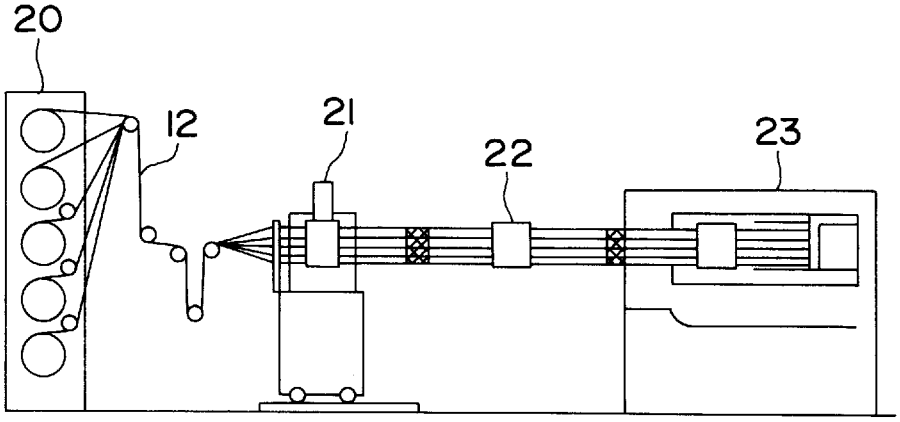
FIG. 2 is a diagram of an apparatus for fabricating the flat multiple-core cable of the first embodiment.

The above flat multiple-core cable is fabricated by an apparatus as shown in FIG. 2. A plurality of flat cables 12 fed in parallel from a core supplying unit 20 are fused and connected in a specified position by a fusing unit 21, thereby forming the first fused portion 16. After the first fused portion 16 is cooled by a cooling unit 22, the connected flat cables 12 are fed to a cutting/peeling unit 23 in which the connected flat cables 12 are cut in a desired position and the insulating sheaths 11 are peeled off at both cut ends. The conductor connecting tape 15 is adhered to the thus obtained flat multiple-core cable.

In the flat multiple-core cable of the first embodiment as described above, since the connection between the respective flat cables 12 is reinforced by the first fused portion 16, the flat cables 12 are unlikely to come apart. Accordingly, unlike the prior art flat multiple-core cable, adhesion of the sheath connecting tape is not necessary to strengthen the connection of the flat cables 12. Thus, the first embodiment can be fabricated at a reduced cost and is suitable for a wiring in a narrow space because nothing bulges therefrom.

Although the above flat multiple-core is formed by the flat cables 12, it may be formed, for example, by circular cables.

Figure 3A:
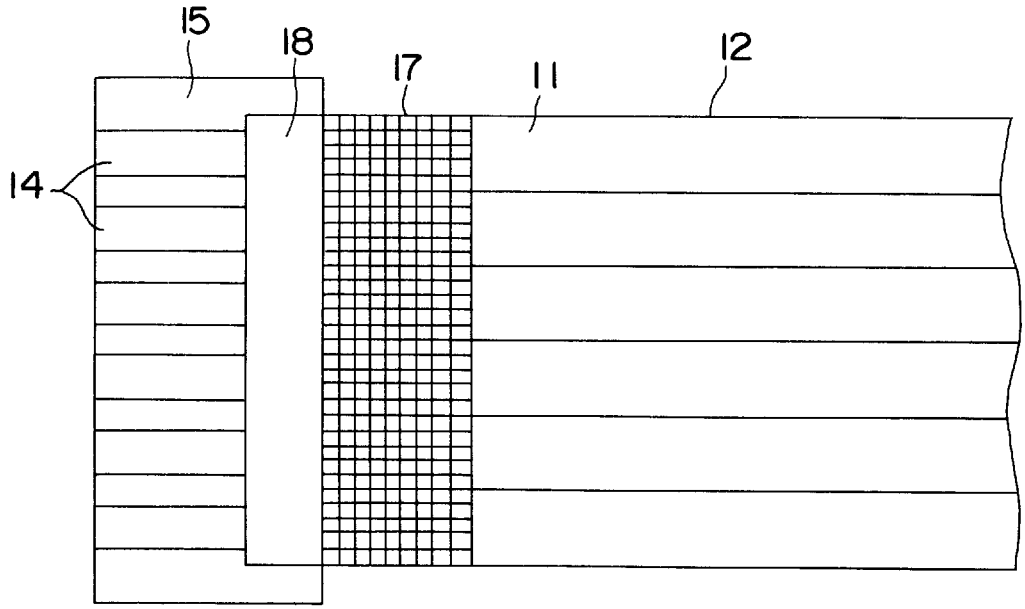
FIGS. 3(*a*) and 3(*b*) are diagrams of a flat multiple-core cable as a second embodiment of the invention.
Figure 3B:
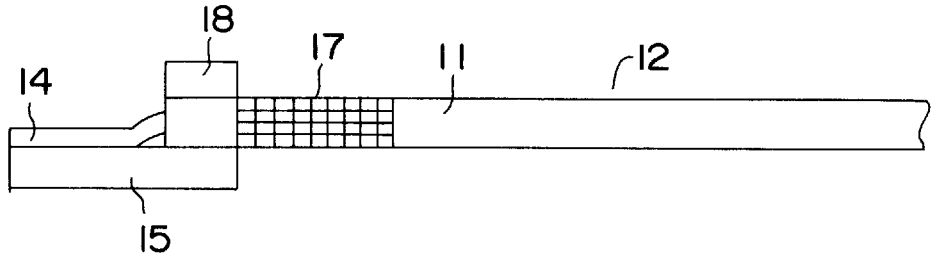

A second embodiment is such as shown in FIG. 3. Specifically, a plurality of flat cables 12 are arranged in parallel, and insulating sheaths 11 are peeled off at opposite ends of the respective flat cable 12, thereby forming a contact portion 14. A conductor connecting tape 15 of insulating resin is adhered to the contact portion 14 and the insulating sheaths 11 near the contact portion 14 on one surface (lower surface) of the arranged flat cables 12. A sheath connecting tape 18 is fused and adhered to the insulating sheaths 11 near the contact portion 14 on the other surface (upper surface) of the flat cables 12 in order to strengthen the connection between the flat cables 12. Further, the insulating sheaths 11 are heated and fused in an area neighbouring the conductor connecting tape 15, thereby forming a second fused portion 17 (hatched portion in FIG. 3), so that adjacent insulating sheaths are connected.

Figure 4:
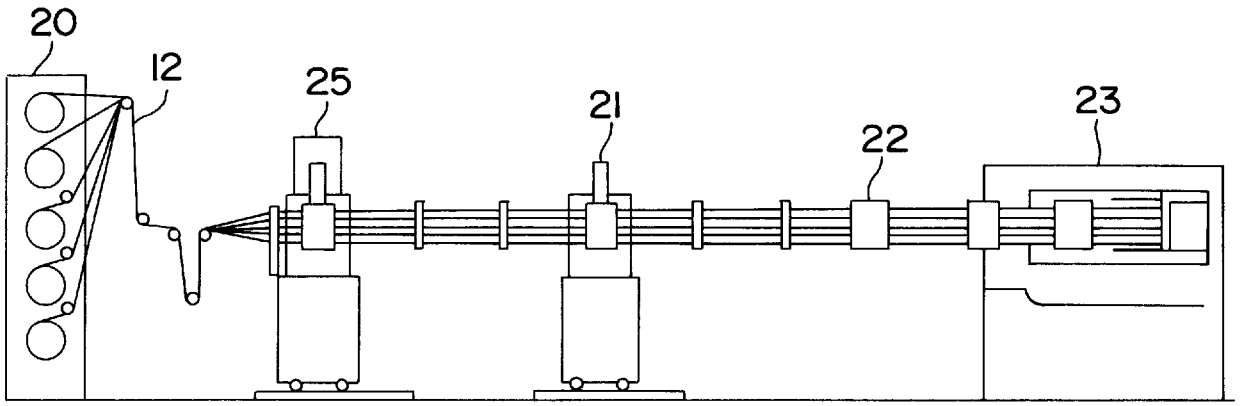
FIG. 4 is a diagram of an apparatus for fabricating the flat multiple-core cable of the second embodiment.

The flat multiple-core cable of the second embodiment is fabricated by an apparatus as shown in FIG. 4. The sheath connecting tape 18 is fused and adhered to the other surface of the flat cables 12 fed in parallel from a core supplying unit 20 by a tape fusing unit 25. Then, the insulating sheaths 11 are fused behind the sheath connecting tape 18 by a fusing unit 21, thereby forming the second fused portion 17. After the second fused portion 17 is cooled by a cooling unit 22, the connected flat cables 12 are fed to a cutting/peeling unit 23 in which the connected flat cables 12 are cut in a desired position and the insulating sheaths 11 are peeled off at both cut ends. The conductor connecting tape 15 is adhered to the thus obtained flat multiple-core cable.

During the insertion of the flat multiple-core cable of the second embodiment into a terminal in an equipment, if the second fused portion 17 is gripped, the respective flat cables 12 are unlikely to be bent since they do not come apart in the gripped position. Since a wide conductor connecting tape is not adhered as in the prior art, this embodiment can be fabricated at a reduced cost. Further, after the insertion into the terminal, the flat multiple-core cable is bent at the second fused portion 17 having a sufficient flexibility. Since the flat multiple-core cable is bent near an opening of the terminal unlike the prior art, it does not press other parts in the equipment.

Although the flat multiple-core of the second embodiment is formed by the flat cables 12, it may be formed, for example, by circular cables.

Figure 5A:
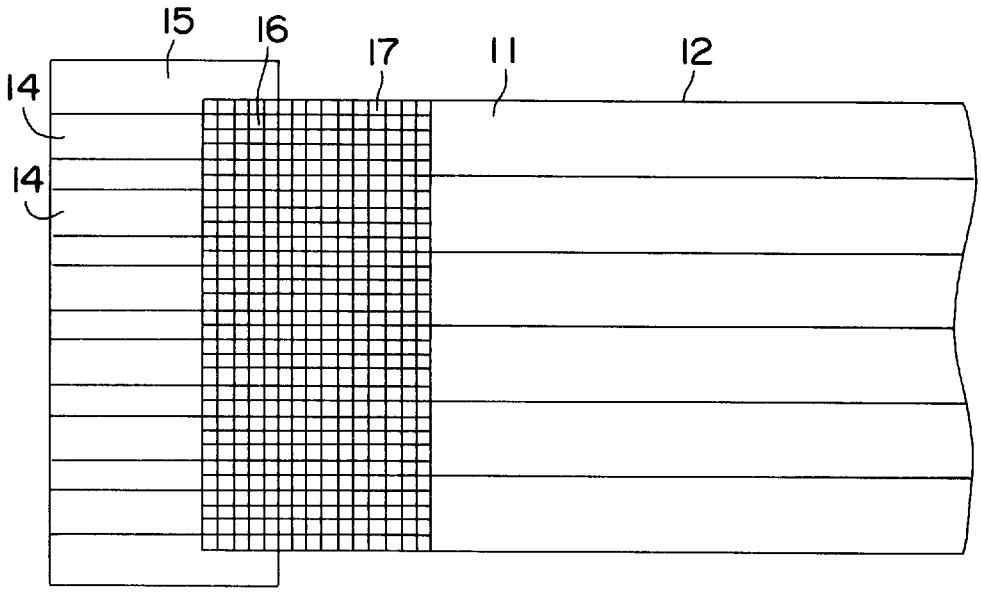
FIGS. 5(*a*) and 5(*b*) are diagrams of a flat multiple-core cable as a third embodiment of the invention.
Figure 5B:
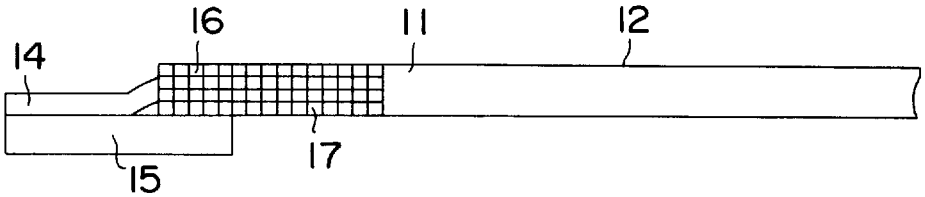

A third embodiment is such as shown in FIG. 5. In this embodiment, insulating sheaths 11 are heated and fused in the first fused portion 16 of the first embodiment shown in FIG. 1 (left side part of a hatched portion in FIG. 5) as well as in an area adjacent, in particular adjoining thereto, thereby forming a second fused portion 17 (right side part of the hatched portion in FIG. 5).

The third embodiment has the same actions and effects as the first and the second embodiments. Further, the first and the second fused portions 16 and 17 can be easily formed in one heating step of the fabrication process.

Although the flat multiple-core of the second embodiment is formed by the flat cables, the same actions and effects can be obtained even if it is formed, for example, by circular cables.

Figure 6A:
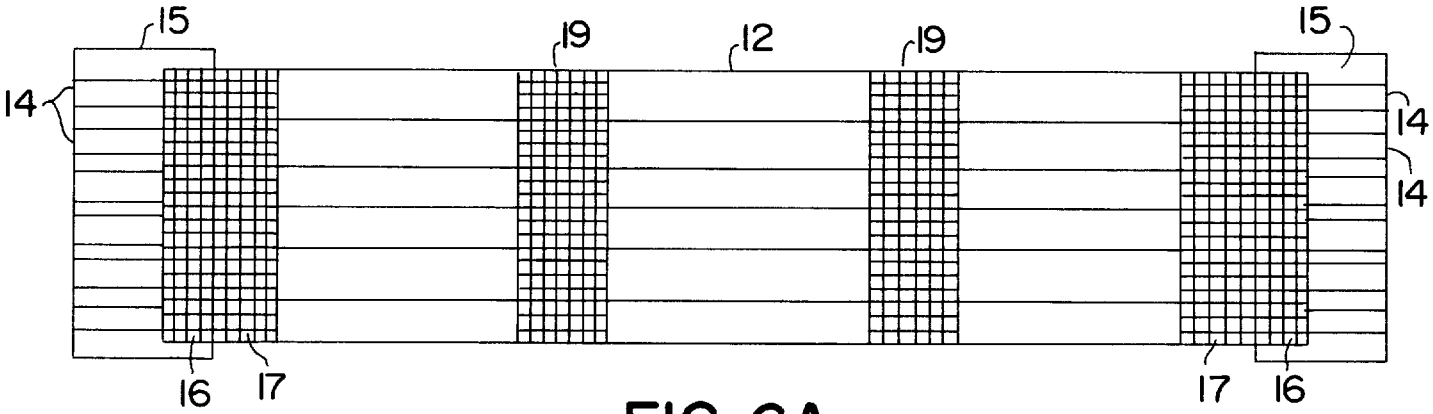
FIGS. 6(*a*) and 6(*b*) are diagrams of a flat multiple-core cable as a fourth embodiment of the invention.
Figure 6B:
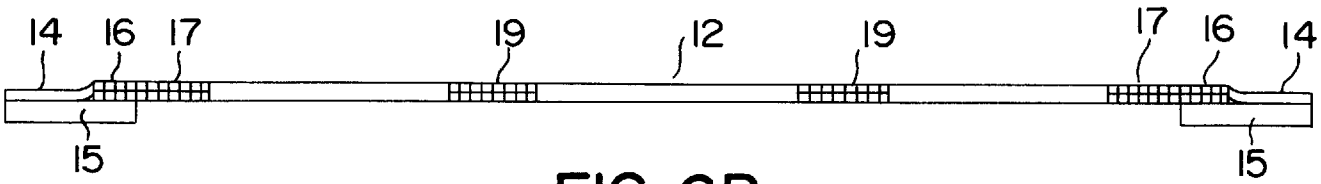

A fourth embodiment is such as shown in FIG. 6. Specifically, a plurality of flat cables 12 are arranged in parallel on a plane, and insulating sheaths 11 are peeled off at opposite ends of the respective flat cable 12, thereby forming a contact portion 14. A conductor connecting tape 15 of insulating resin is adhered to the contact portion 14 and the insulating sheaths 11 near the contact portion 14 on one surface (lower surface) of the arranged flat cables 12. The insulating sheaths 11 are heated and fused in an area neighbouring the conductor connecting tape 15, thereby forming a first fused portion 16, so that adjacent insulating sheaths 11 are connected. The insulating sheaths 11 are fused in an area neighbouring the first fused portion 16 and opposing to the contact portion 14, thereby forming a second fused portion 17. The insulating sheaths 11 are also fused in two intermediate positions of the respective flat cables 12, thereby forming third or intermediate fused portions 19.

Figure 7:
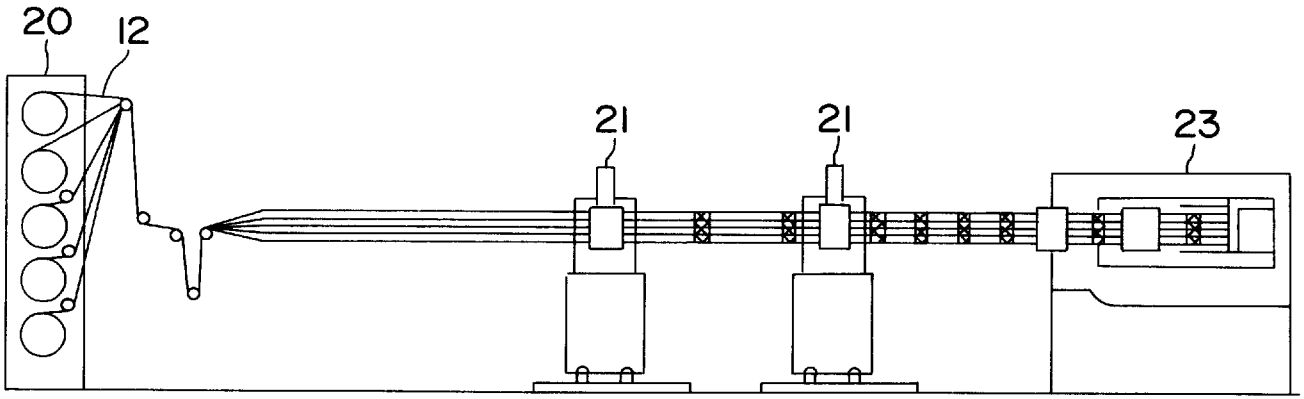
FIG. 7 is a diagram of an apparatus for fabricating the flat multiple-core cable of the fourth embodiment.
Figure 8A:
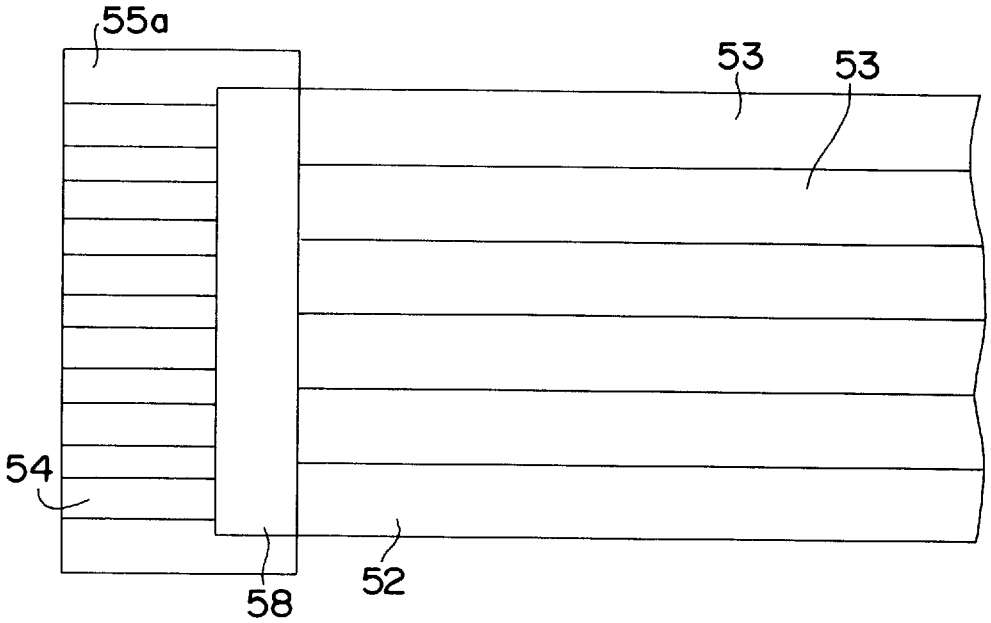
FIG. 8A PRIOR ART
FIGS. 8(*a*) and 8(*b*) are diagrams of a prior art flat multiple-core cable.
Figure 8B:
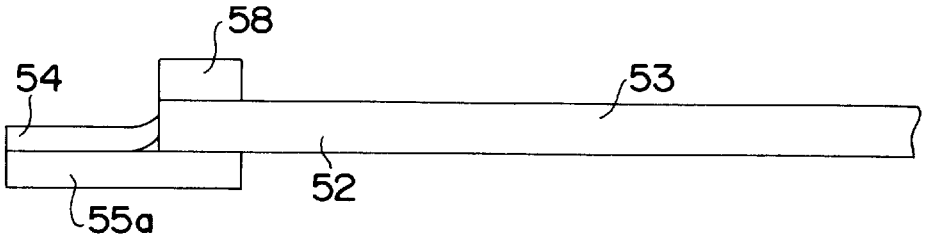
FIG. 8B PRIOR ART
Figure 9A:
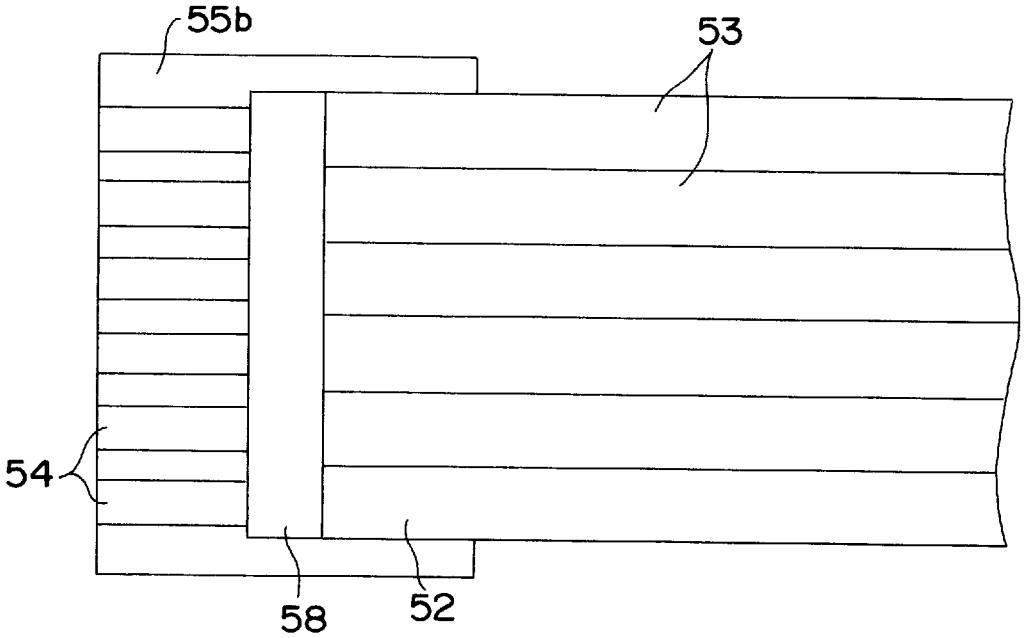
FIG. 9A PRIOR ART
FIGS. 9(*a*) and 9(*b*) are diagrams of another prior art flat multiple-core cable.
Figure 9B:
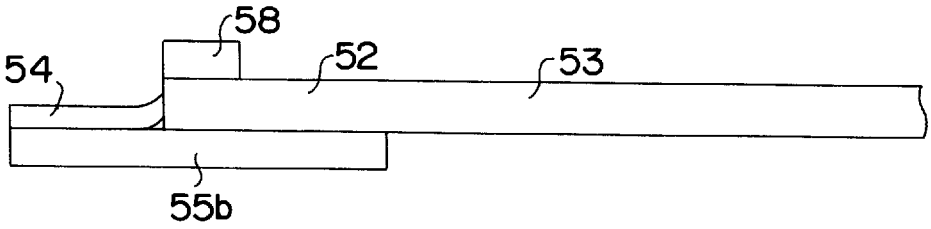
FIG. 9B PRIOR ART
Figure 10A:
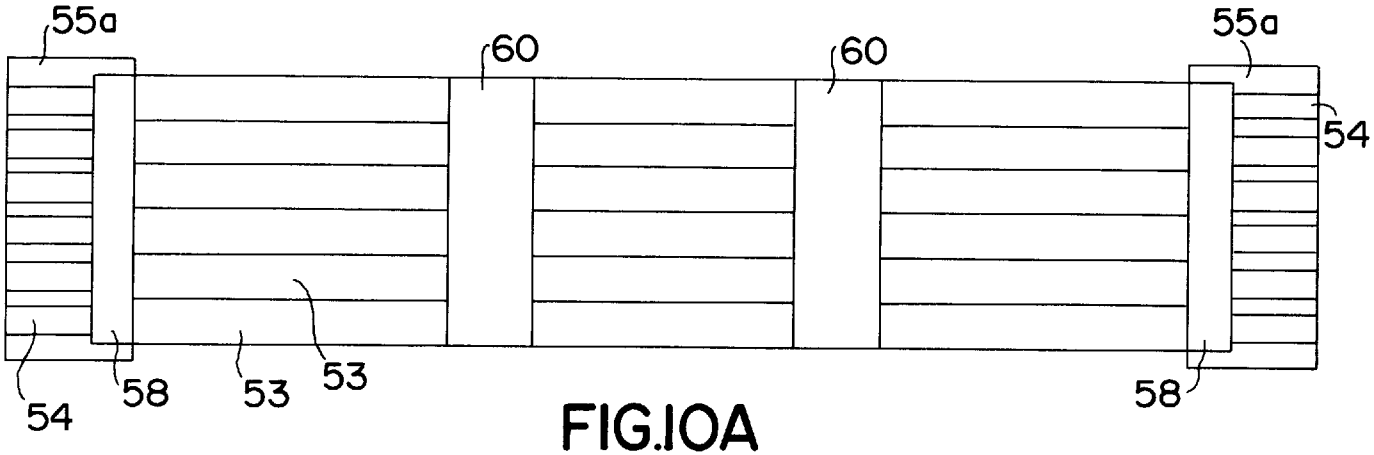
FIG.10A PRIOR ART
FIGS. 10(*a*) and 10(*b*) are diagrams showing how flat cables are fixed in intermediate positions of a prior art flat multiple-core cable.
Figure 10B:
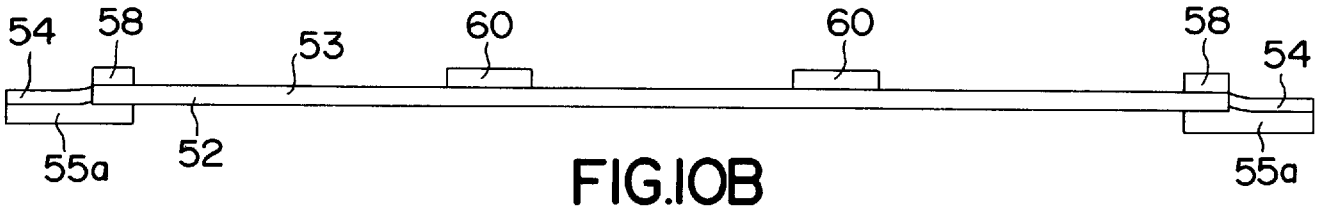
FIG.10B PRIOR ART
Figure 11A:
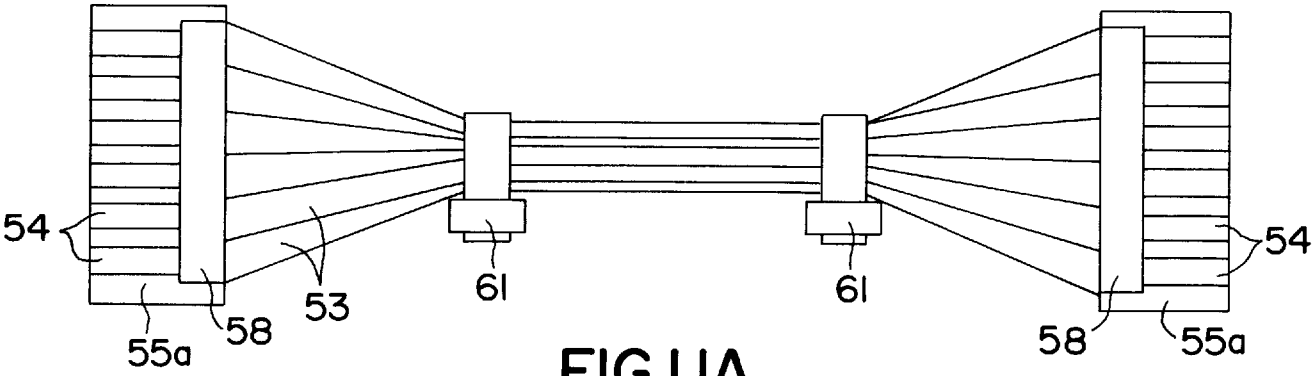
FIG. 11A PRIOR ART
FIGS. 11(*a*) and 11(*b*) are diagrams showing how flat cables are fixed in intermediate positions of another prior art flat multiple-core cable.
Figure 11B:
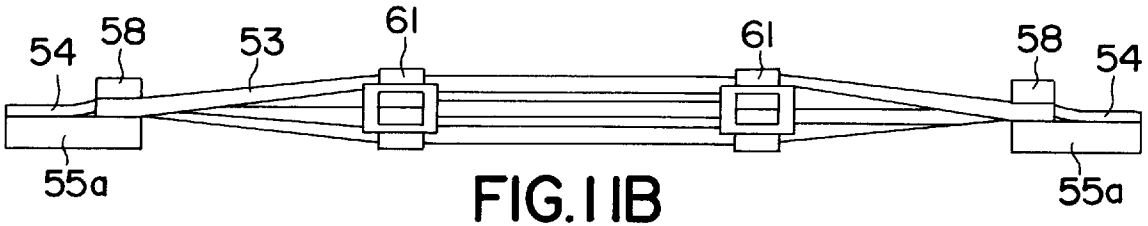
FIG. 11B PRIOR ART
Figure 12:
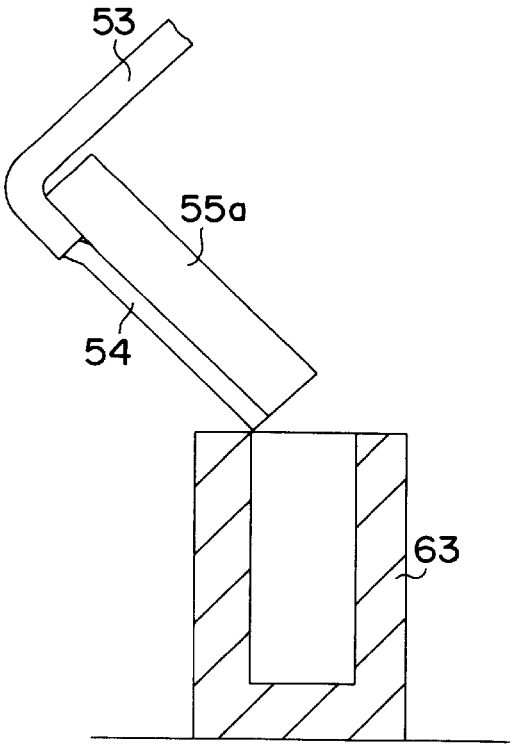
FIG. 12 PRIOR ART
FIG. 12 is a section showing a problem residing in a prior art flat multiple-core cable.
Figure 13:
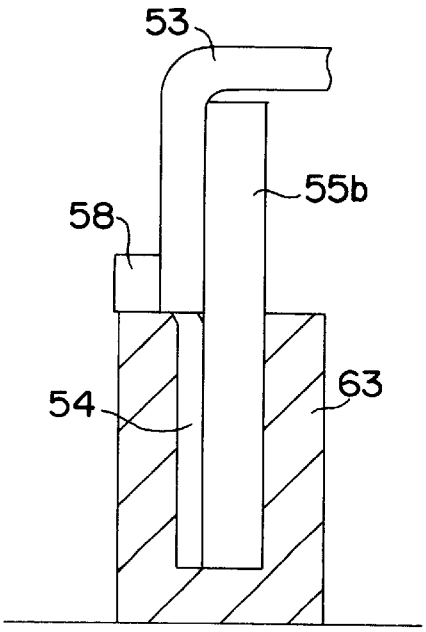
FIG. 13 PRIOR ART
FIG. 13 is a section showing another problem residing in a prior art flat multiple-core cable.

The flat multiple-core cable of the fourth embodiment is fabricated by an apparatus as shown in FIG. 7. The insulating sheaths of the flat cables 12 fed in parallel from a core supplying unit 20 are fused by a fusing unit 21, thereby forming the first and the second fused portions 16 and 17. Thereafter, the third fused portions 19 are formed in the intermediate positions by the fusing unit 21. After the connected flat cables 12 are cut in a desired position, the insulating sheaths 11 are peeled off at both cut ends. The conductor connecting tape 15 is adhered to the thus obtained flat multiple-core cable.

The flat multiple-core cable of the fourth embodiment has the same actions and effects as the third embodiment. In addition, since the respective flat cables 12 are connected in their intermediate positions at a distance from their ends by the third fused portions 19, it is unnecessary to fuse and adhere a tape to the flat cables 12 or to tie them with bandings. Thus, a production cost can be reduced. Further, this cable is suitable for use in a narrow space because it has neither pronounced projections nor tied portions, i.e. because it is flat. Further, the obtained flat multiple-core cable is not shortened as in the case where the respective flat cables 12 are tied in the intermediate positions.

Although the third fused portions 19 are formed in two intermediate positions in the foregoing embodiment, they may be formed in one, three or more intermediate positions.

What is claimed is:

1. A flat multiple-core cable, comprising:

a plurality of elongate cables (12) arranged in parallel, each of said cables (12) having opposed ends and comprising a conductor and an insulating sheath (11) covering the conductor, a contact portion (14) formed of the conductors exposed by peeling off the insulating sheaths (11) of the cables (12) at at least one of their ends, a conductor connecting tape (15) adhered to the exposed conductors defining the contact portion (14) and to portions of the insulating sheaths (11) adjoining the exposed conductors defining said contact portion (14), and at least one bend-resistant fused portion (16; 17) formed by fusing and connecting the insulating sheaths (11) in at least one area, including an area adjacent to the contact portion (14), said fused portion (16; 17) defining a length measured parallel to said elongate cables (12) such that major portions of said elongate cables (12) are not fused along said flat multiple core cable, said fused portion (16; 17) adjacent the contact portion (14) including an overlapped fused portion (16) at least partly overlapping with the portion of the insulating sheaths to which the conductor connecting tape (15) is adhered and an extension fused portion (17) which extends unitarily from the overlapped fused portion (16) to an area adjacent to the conductor connecting tape (15).

2. A flat multiple core cable according to claim 1, wherein the conductor connecting tape (15) is provided on one surface of the cables (12) and wherein a sheath connecting tape (18) is adhered to the insulating sheaths (11) on the other surface of the cables (12).

3. A flat multiple core cable according to claim 2, wherein the sheath connecting tape (18) is provided adjacent to the contact portion (14).

4. A flat multiple core cable according to claim 1, wherein the fused portion (16; 17) is a fused end portion (16; 17), the flat multiple core cable further comprising at least one substantially flat intermediate fused portion (19) formed by fusing and connecting the insulating sheaths (11) in an intermediate area of the cables (12), said intermediate fused portion (19) being spaced along the flat cable from the fused end portion (16; 17), the fused end portion (16; 17) and the intermediate fused portion (19) defining lengths measured parallel to the cables (12) substantially less than the spacing therebetween.

5. A flat multiple core cable according to claim 4, wherein the fusing is provided by fusing means selected from the group consisting of melting, gluing, ultrasonic welding, and a solvent.

6. A flat multiple core cable according to claim 1, wherein the conductor of each of said cables (12) is a flat rectangular conductor comprising a copper foil.

* * * * *